US005657847A

United States Patent [19]

Tod et al.

[11] Patent Number: 5,657,847

[45] Date of Patent: Aug. 19, 1997

[54] BANKNOTE VALIDATOR

[75] Inventors: Timothy William Tod; Anthony William Tod; Richard Timothy Tod, all of Gwent, Great Britain

[73] Assignee: Innovative Technology Limited, Royton, England

[21] Appl. No.: 204,310

[22] PCT Filed: Oct. 1, 1992

[86] PCT No.: PCT/GB92/01809

§ 371 Date: Aug. 26, 1994

§ 102(e) Date: Aug. 26, 1994

[87] PCT Pub. No.: WO93/07590

PCT Pub. Date: Apr. 15, 1993

[30] Foreign Application Priority Data

Oct. 1, 1991 [GB] United Kingdom ..... 9120848

[51] Int. Cl.[6] ..... G07F 7/04

[52] U.S. Cl. ..... 194/207; 250/556

[58] Field of Search ..... 194/206, 207; 250/556; 382/135; 271/188

[56] References Cited

U.S. PATENT DOCUMENTS

| | | | |
|---|---|---|---|
| 3,738,642 | 6/1973 | Blaire | 271/188 X |
| 3,942,153 | 3/1976 | Balko et al. | 271/188 X |
| 4,041,456 | 8/1977 | Ott | 382/7 |
| 4,090,243 | 5/1978 | Kotera et al. | 364/526 |
| 4,352,988 | 10/1982 | Ishida | 250/559 |
| 4,592,090 | 5/1986 | Curl et al. | 382/7 |
| 4,640,505 | 2/1987 | Placke et al. | 271/188 X |
| 4,662,626 | 5/1987 | Shores et al. | 271/188 X |
| 5,156,250 | 10/1992 | Parish et al. | 194/348 |
| 5,316,124 | 5/1994 | Barnes et al. | 382/135 X |

FOREIGN PATENT DOCUMENTS

| | | | |
|---|---|---|---|
| 0056116 | 7/1982 | European Pat. Off. . | |
| 0101276 | 2/1984 | European Pat. Off. . | |
| 2443107 | 6/1980 | France . | |
| 2713396 | 9/1978 | Germany . | |
| 63-230471 | 9/1988 | Japan | 271/188 |
| 2038063 | 7/1980 | United Kingdom . | |

*Primary Examiner*—F. J. Bartuska
*Attorney, Agent, or Firm*—Morgan & Finnegan, LLP

[57] ABSTRACT

The note path of a banknote validator has a U-shaped transverse cross section. A transverse strip of the note path is illuminated by light from a light transmitting station by means of a unitary light guide which has an arcuate portion conforming to the transverse cross section of the note path. Light reflected from a banknote, within the note path, is captured by the light guide and guided to a light receiving station. The light guide is shaped such that a transverse strip of the note path is substantially evenly illuminated. The U-shape of the note path also assists the insertion of notes into the validator, as an inserted note is caused to bow during insertion thereby increasing its rigidity.

31 Claims, 6 Drawing Sheets

FIG. 3a.
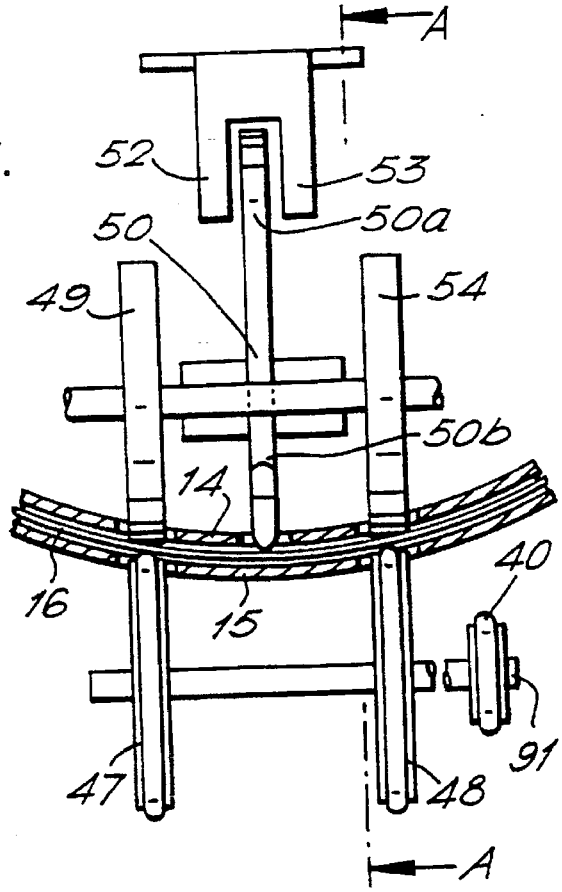
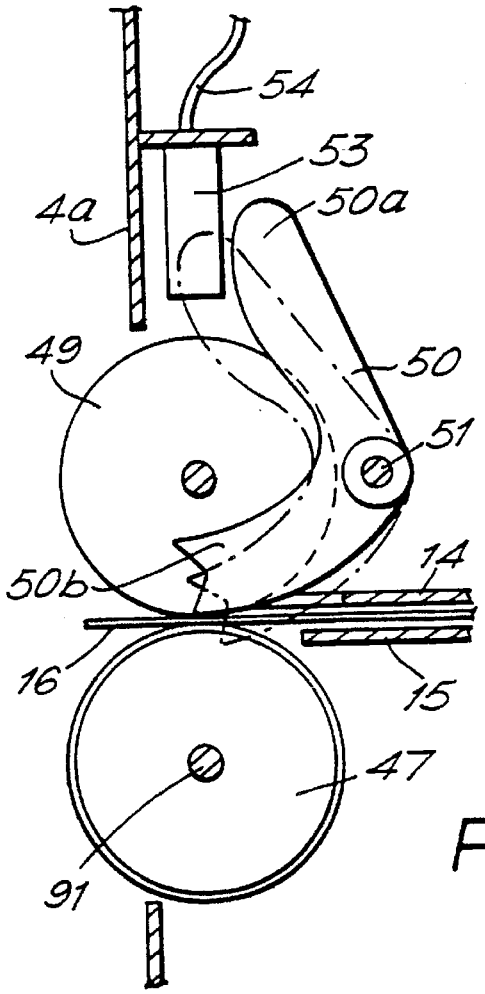
FIG. 3b.

FIG. 7.
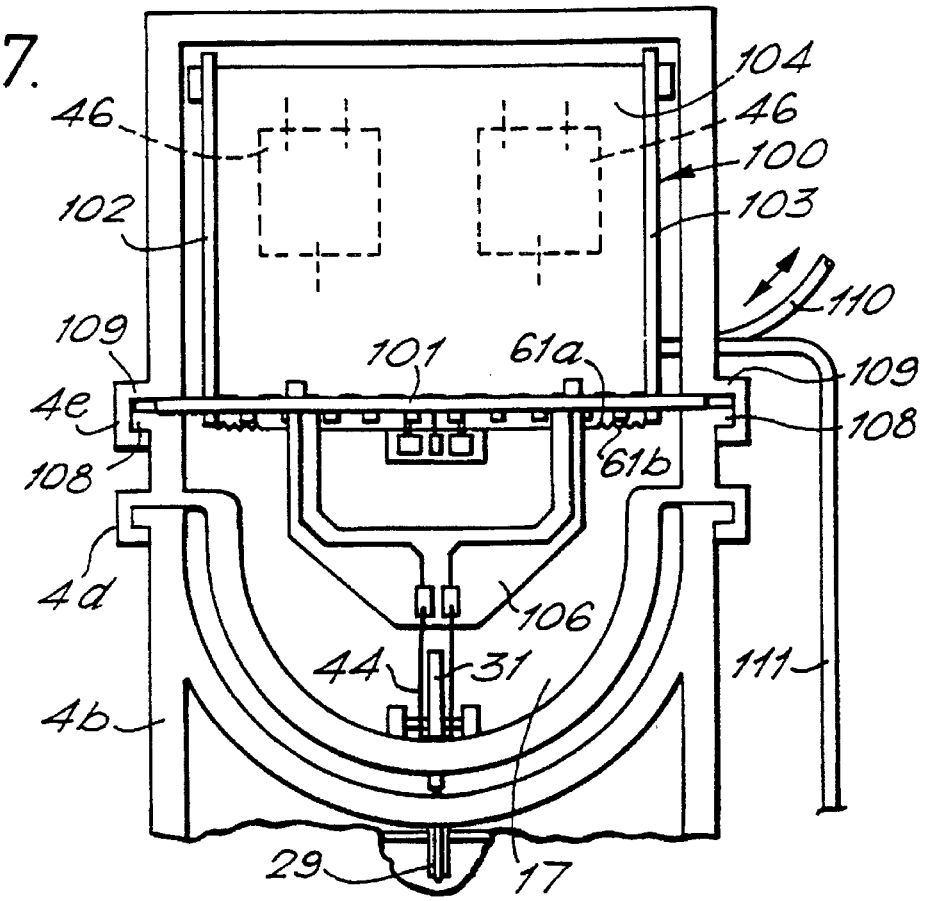
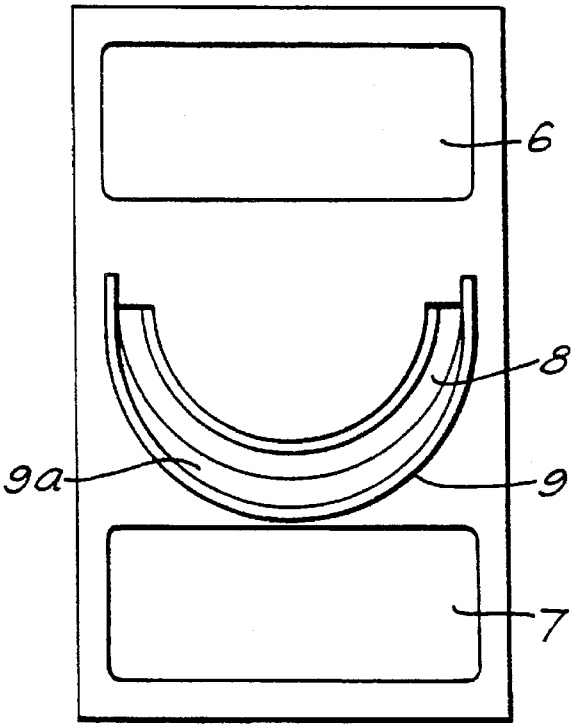
FIG. 8.

BANKNOTE VALIDATOR

FIELD OF THE INVENTION

The present invention relates to a validator suitable for validating banknotes.

BACKGROUND TO THE INVENTION

Conventional banknote validators such as the Armatic type AL07 comprise a straight slot through which bank notes are fed and a transport mechanism in the form of a plurality of parallel rollers. In order for the authenticity and value of a banknote to be determined, such apparatus includes optical sensing means. In the aforementioned known validator, the optical sensing means comprises two linear arrays of optical transmitters and receivers arranged across the width of the transport mechanism and two sheet-like light guides having a J-shaped cross-section which direct light from the optical transmitters on to either side of a bank note to be validated and the reflected light back to the optical receivers.

Such validators suffer from a number of disadvantages. Firstly, a banknote being fed into the validator is prone to become crumpled during the operation. Secondly, the use of a large number of optical transmitters complicates the manufacture of the apparatus and necessitates regular balancing of the light levels emitted by the optical transmitters. A further disadvantage arises from the use of a flat transport mechanism since in order to accommodate a full range of bank notes the validator must be significantly wider than conventional coin validators which makes them unsuitable for use in most common vending machines. Yet another disadvantage is the need for a complex power supply for supplying the processor employed in the apparatus to determine the authenticity and value of banknotes to be validated. The present invention aims to overcome the aforementioned disadvantages.

A banknote validator is known from European Patent No. 72237, which includes an optical sensing means for sensing characteristics of a sheet, and guide means for guiding the sheet past the optical sensing means. An elongate optical sensing area extends transversely of the sheet path and light reflected from the surface of a banknote is guided to a single sensing station via a fishtail optical fibre array.

SUMMARY OF THE INVENTION

According to a first aspect of the present invention there is provided a validator, suitable for validating a banknote, including an optical sensing means or sensing characteristics of a sheet, and guide means for guiding the sheet past the optical sensing means, characterised in that said guide means is so arranged that a sheet to be validated is caused to bow transversely of its direction of travel past the optical sensing means.

Preferably the guide means includes a sheet path, along which a sheet, to be sensed passes and the optical sensing means comprises an elongate optical sensing area, transversely substantially coextensive with the sheet path, light source means for substantially evenly illuminating said sensing area over at least a major part thereof, an optical receiver station, and light guide means for causing light from the entire sensing area to converge upon the receiver station, whereby the output from the receiver station is substantially independent of the position of a sheet being sensed transversely of the sheet path.

Preferably the light source means includes a light source at an emitter station, and said light guide is arranged to cause light to diverge from the emitter station to the sensing area. The emitter station and the receiver station may be arranged at the same location.

Advantageously, the light guide includes a fan shaped portion, having an arcuate peripheral portion which at least in part defines said sensing area. The light guide may also include an arm portion, extending axially from the fan shaped portion, at the free end of which are located the emitter station and the receiver station.

Conveniently, the light guide includes light distributing means including an at least part conical light reflecting surface extending from the fan shaped portion towards the free end of the arm portion for distributing light from the emitter station substantially evenly about the arcuate peripheral portion of the fan shaped portion.

Advantageously, the generally straight peripheral portion of the fan-shaped portion is provided with light scattering means, for example a plurality of peaks and troughs.

Advantageously, the light guiding means comprises a one-piece moulding.

Conveniently, the emitter station and the receiver station may each comprise a plurality of opto-electronic transducers.

Preferably, the validator includes an electronics module comprising a self-supporting three-dimensional printed circuit board. More preferably, the printed circuit board comprises a plurality of sub-boards, each sub-board including a coupling means to engage an adjacent sub-board to provide both a structural and an electrical connection. The connection may be in the form of a soldered mortise and tenon joint. However, other forms of joint such as dove-tail joints may be employed. This avoids the need for edge connectors which are a common source of failure in electronic equipment.

Conveniently, the module is readily removable. With such an arrangement, the validator need not be re-programmed "on-site" in response to changes in the notes in circulation. The electronics module need only be replaced by a pre-programed replacement.

According to a second aspect of the present invention there is provided a validator, suitable for validating a banknote, including sheet input means, characterised in that the sheet input means is arranged such that a sheet to be validated is deformed in a predetermined rigidity increasing manner during insertion into the input means, e.g. deformed to have a U-, C-, O- or S-shaped cross-section.

Preferably, the sheet input means comprises a slot through which a sheet passes for input into the validator.

Conveniently, the sheet input means is arranged to ensure that a sheet, being input into the validator, is bowed across its direction of travel.

Preferably, the validator includes a sheet guiding surface which follows the shape of the slot. If a U-Shaped slot is employed, the sheet guiding surface may be advantageously made to slope downwards in the region of the base of the U of the slot. This assists in the insertion of a note and aids in the prevention of the ingress of rain water, should the validator be located out of doors.

According to a third aspect of the present invention there is provided a validator, suitable for validating a banknote, including sheet detecting means for detecting the presence of a sheet in the validator, sheet scanning means for producing a signal representative of a characteristic of a sheet, primary power supply means and processing means for processing said sheet characteristic representing signal and having an active state and an inactive state, characterised by battery means, and in that the processing means is temporarily powered by the battery means in its active state in response to the sheet detecting means detecting the presence of a sheet in the validator.

Preferably, the battery means comprises a rechargeable battery, for example a nickel-cadmium battery, which is charged from the primary power supply means when the processing means is in its inactive state.

BRIEF DESCRIPTION OF THE DRAWINGS

FIG. 3*a* is a rear view, with the rear wall of the validator omitted, and FIG. 3*b* is a sectional view along A—A in FIG. 3*a*, including the validator rear wall, of the rear part of the banknote drive train of the validator shown in FIG. 1;

FIG. 7 shows the disposition of an electronics module in an embodiment of a validator according to the present invention; and FIG. 8 is an alternative front panel arrangement for a validator according to the present invention.

DESCRIPTION OF EMBODIMENTS

Embodiments of the present invention will now be described, by way of example, with reference to the accompanying drawings.

For convenience, the validator shown in FIG. 1 will be described as oriented therein.

Figure 1:
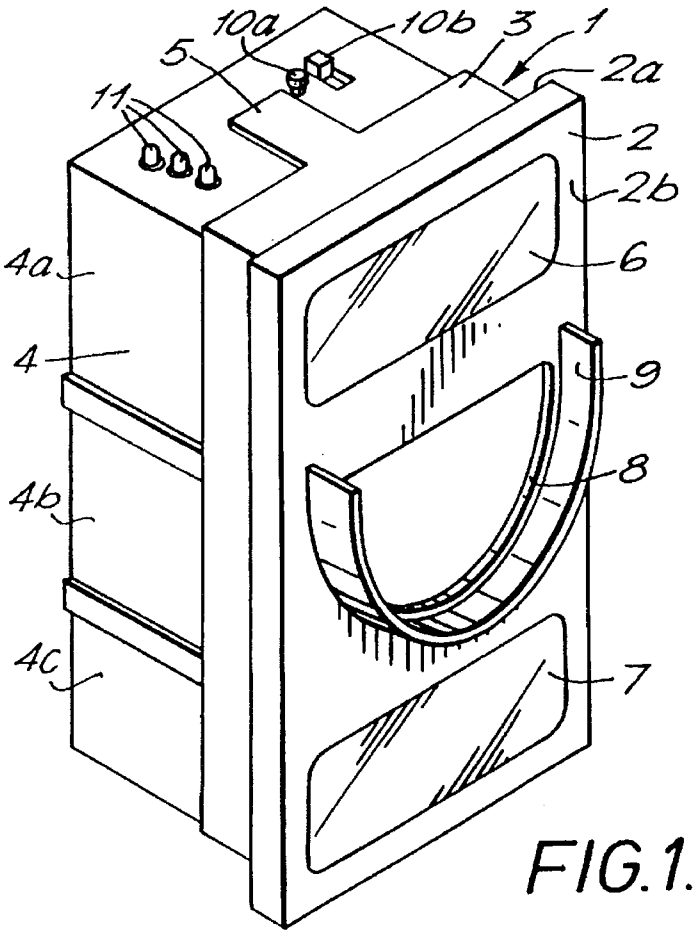
FIG. 1 is a perspective view of a validator according to the present invention.

Referring to FIG. 1, a banknote validator 1 has a rectangular facia 2. A wall 3 extends rearwardly from the margins of the rear face 2*a* of the facia 2. An operating section 4, comprising three, i.e. upper, middle and lower, interlocking units 4*a*, 4*b*, 4*c*, is received within the wall 3. The operating section 4 is held in position by means of a hooked tab 5 which engages a complimentary slot in the upper operating section unit 4*a* and by a similar tab (not shown) which cooperates with a similar slot (not shown) in the lower 4*c*.

First 6 and second 7 display panels are respectively located towards the top and bottom of the facia 2. The display panels 6,7 bear legends, such as "£5, £10 or £20", which may be illuminable. A U-shaped entrance slot 8 to receive a banknote is located in the facia 2 between the first 6 and second 7 display sections. A lip 9, conforming to and adjacent to the curve of the lower edge of the slot 8, extends away from the front face of the facia 2.

Switches 10*a*, 10*b* and three status indicating LEDs extend through the upper wall of the upper unit 4*a* of the operating section 4. The switch 10*b* is a slide switch which is used to swatch the apparatus between a run mode and a learn mode. Switch 10*a* is a push button switch which is used as a channel select switch during the learn mode.

Figure 2:
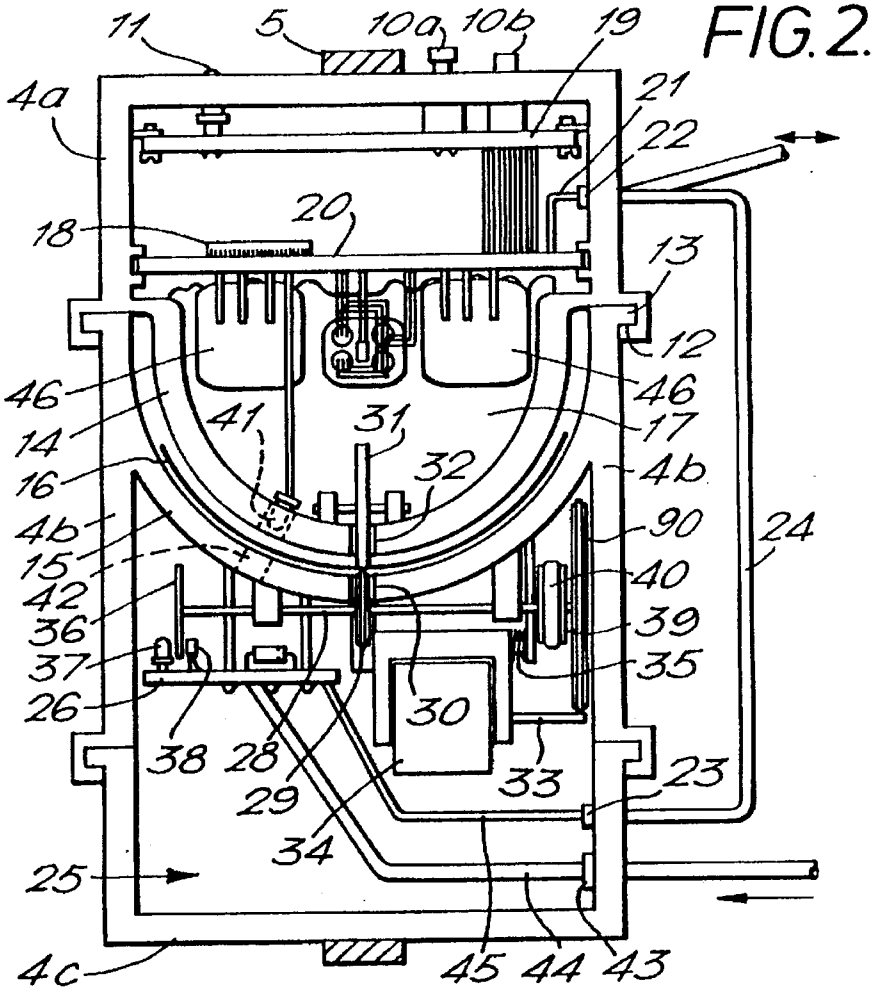
FIG. 2 is a front view of the validator shown in FIG. 1 with its facia removed.

Referring to FIGS. 2, 3*a* and 3*b*, the lower margins of the side walls of the upper operating section unit 4*a* are stepped outwardly and provided with inwardly facing grooves 12. The upper margins of the side walls of the middle operating section 4*b* are provided with rails 13 shaped so as to be received by the grooves 12. These structures allow the upper operating section unit 4*a* to be slid relative to the middle operating section unit 4*b* for assembly and disassembly. The middle operating section unit 4*b* is similarly coupled to the lower operating section unit 4*c*.

The lower wall 14 of the upper operating section unit 4*a* and the upper wall 15 of the middle operating section unit 4*b* are bowed downwardly such that when these units are coupled together a U-shaped aperture extends from the front of the operating section 4 to the rear of the operating section 4 through which a banknote 16 may pass from the entrance slot 8 (FIG. 1).

A fan-shaped radial light guide 17 has a constant radius arcuate surface which conforms to the curve of the lower wall of the upper operating section unit 4*a* and is located in a slot therein so that light may be directed onto the full width of the banknote 16. A strip of retroreflective material (not shown) is affixed to the upper surface of the upper wall of the middle operation section unit 4*b*, opposite the arcuate surface of the fan shaped light guide 17.

The LEDs 11 and the switches 10*a*, 10*b* are mounted on a PCB 19 located within the upper operating section unit 4*a*. A second PCB 20 is mounted immediately above the fan-shaped light guide 17 and carries, amongst other components, a processor 18. Optical transmitters 63, 64 and an optical receiver 65 mounted on the fan-shaped light guide 17 (see FIG. 4*b*) are coupled directly to the PCB 20. Power is supplied to, and data and control signals transferred to and from, the circuits mounted on the PCBs 19, 20 via wires 21 connected to the male part of a connector 22 mounted in a side wall of the upper operating section unit 4*a*. The female part of the connector 22 is connected to the male part of a similar connector 23, mounted in a side wall of the lower operating section unit 4*c*, by means of a flying lead 24.

A pair of nickel-cadmium batteries 46 are suspended from the PCB 20 in front of the fan-shaped light guide 17. A space 25, defined within the middle 4*b* and lower 4*c* operating section units when coupled together, contains a banknote drive train and an additional PCB 26. The drive train comprises a main axle 28 which depends from the upper wall 15 of the middle operating section unit 4*b* and extends transverse to the direction of travel of the banknote 16. A front drive wheel 29, mounted on the axle 28, extends through a slot 30 in the upper wall 15 of the middle operating section unit 4*b* where it cooperates with an idler wheel 31 mounted in the upper operating section unit and extending through a slot in the lower wall 14 thereof, to propel the banknote 16 through the validator 1. A large diameter wheel 90 is mounted at one end of he axle 28 and is driven directly by the spindle 33 of a dc motor 34. The motor 34 is pivotally mounted on the upper wall 15 of the middle operating section 4*b* and a spring 35 acts on the motor 34 to urge the spindle 33 against the rim of the large diameter wheel 90. An apertured wheel 36 is mounted at the end of the axle 28 remote from the large diameter wheel 90. The apertured wheel 36 cooperates with an optical transmitter 37 and an optical receiver 38, both mounted on the PCB 26, to form a rotation sensor. A further wheel 39 is mounted on the axle 28 adjacent the large diameter wheel 90 and is coupled to a further axle 91 (see FIGS. 3*a* and 3*b*) by a toothed belt 40. The further axle 91 supports a pair of spaced drive wheels 47, 48 which cooperate with respective idler wheels 49, 54 in a similar manner to the drive wheel 29 and the idler wheel 31. The drive train components, with the exception of the motor 34, are moulded from plastics resin material. O-rings are mounted about the rims of the large diameter wheel 90 and the drive wheels 29, 47, 48. The use of the O-rings ensures that there is adequate friction between the large diameter wheel 32 and the spindle 33 and between the drive wheels 29, 47, 48 and the banknote 16.

A wake up sensor comprises an optical transmitter 41, mounted in the upper wall 15 of the lower operating section unit 4*c*, and an optical receiver (not shown) mounted adjacent to the optical transmitter 41. The upper wall 15 of the lower operating section unit 4*c* is provided with a hole 42 opposite the optical transmitter 41 and its associated optical receiver. Both the optical transmitter 41 and the optical receiver are coupled to the PCB 20 in the upper operating section unit 4*a*.

Power enters the validator 1 via connector 43, mounted in a side wall of the lower operating section unit 4*c*, and is conveyed to the PCB 26 by wires 44. Power for the PCBs 19, 20 in the upper operating section unit 4*a* is conveyed along wires 45 to the female parts of the connector 23. Data is exchanged between the validator 1 and external circuits via wires extending from the connector 22 in the upper operating section unit 4*a*.

Referring specifically to FIGS. 3*a* and 3*b*, a banknote clear sensor comprises an L-shaped member 50 pivoted about a horizontal axis at its elbow 51 which is directed towards the front of the validator 1. An optical transmitter 52 and an optical receiver 53 are mounted on a ledge extending from the rear wall of the upper operating section unit 4*a* and are coupled to the PCB 19 by wires 54. The optical transmitter 52 and the optical receiver 53 are arranged such that the upper arm 50*a* of the L-shaped member 50 can be caused to selectively interrupt the light path therebetween. The lower arm 50*b* of the L-shaped member 50 extends downwardly and rearwardly between the idler wheels 49, 54, where it is acted upon by the banknote 16 during its passage.

Figure 4A:
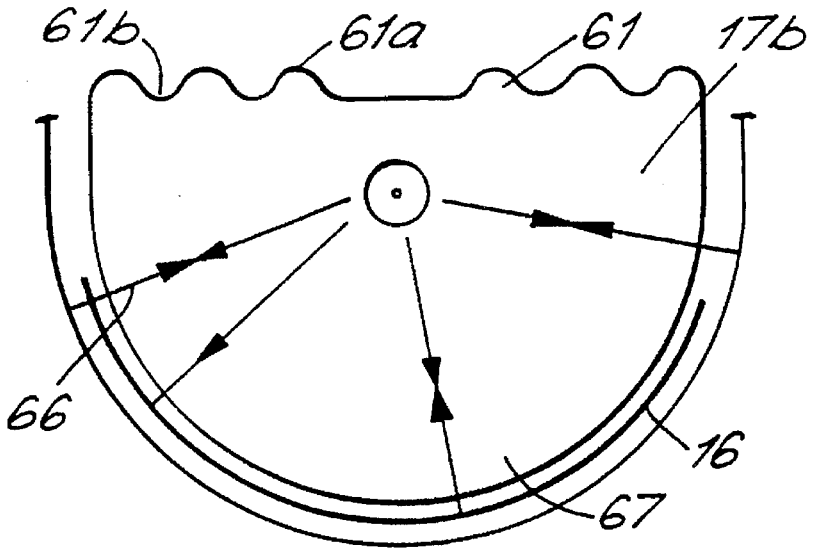
FIGS. 4*a* and 4*b* are front and side views respectively of the light guiding means of the validator shown in FIG. 1.
Figure 4B:
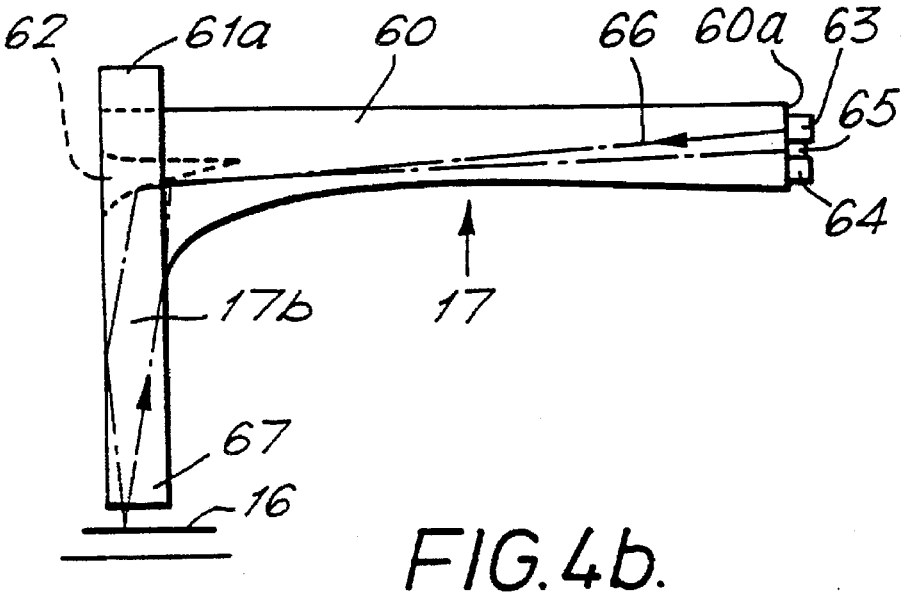

Referring to FIGS. 4*a* and 4*b*, the fan-shaped optical light guide 17 has an arm portion 60 extending normal to the plane of a fan-shaped portion 17*b* adjacent to the centre of its straight margin 61. A conical indentation 62 extends into the arm portion 17*a* from the fan-shaped portion 17*b* coaxial with the centre of curvature of its arcuate margin 67. In practice the side wall of the conical indentation 62 may be bowed inwardly. A pair of tri-colour LEDs 63 and a pair of infra-red LEDs 64 are arranged in a square around an optical receiver 65 on the free end 60*a* of the arm portion 60. The optical receiver 65 is coaxially aligned with the cone shaped indentation 62. The tri-colour LEDs 63 comprise a red LED and a green LED in a single package. The red and green LEDs may be selectively energised to produce red, green or yellow effects, hence "tri-colour".

Light rays 66 emitted the LEDs 63, 64 travel along the arm portion 60, either directly or by means of internal reflection, to the cone shaped indentation 62, from which they are reflected radially through the fan-shaped portion 17*b*. The shape of the cone shaped indentation 62 results in the light rays 66 being distributed about the fan-shaped portion 17*b*. Any light rays 66 which emerge from the fan-shaped portion 17*b*, and are then reflected back thereto, are guided back to the cone shaped indentation 62 by which they are directed towards the optical receiver 65.

In order to avoid the occurence of bright spots around the arcuate margin 67 of the fan shaped portion 17*b*, the straight margin 61 of the fan shaped portion 17*b* is provided with peaks 61*a* and troughs 61*b*.

Figure 5:
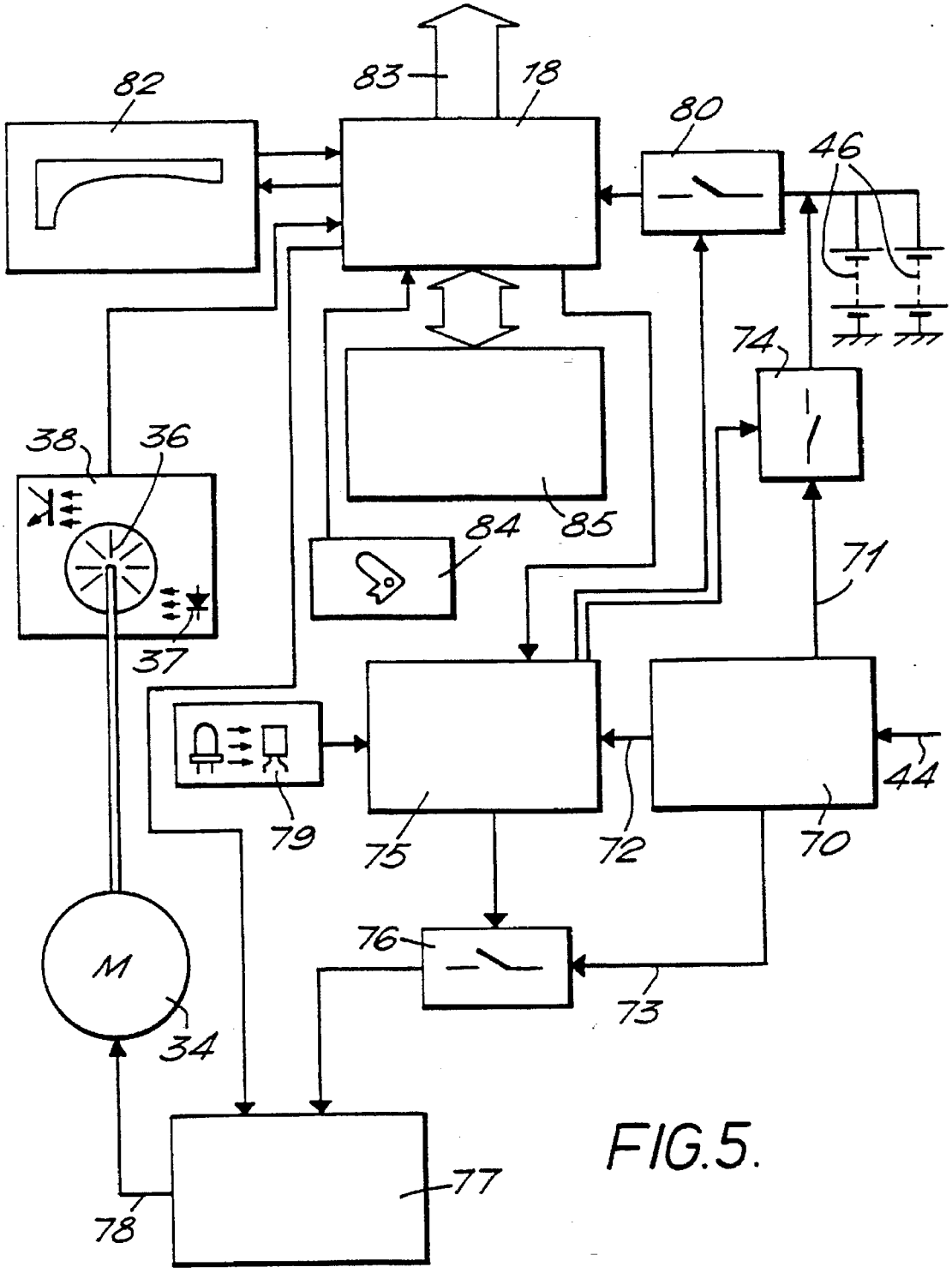
FIG. 5 is a block diagram of the electrical circuit of the validator shown in FIG. 1.

Referring to FIG. 5, a primary power supply circuit 70, including a main voltage regulator, receives power from the wires 44. The primary power supply circuit 70 has three outputs 71, 72, 73. The first output 71 is fed to a solid state switch 74 by which it is selectively coupled to the battery pack 46 for charging thereof. The second output 72 goes to a switching control circuit 75 and the third output 73 goes to a second solid state switch 76 by which it is selectively connected to a motor control circuit 77. The motor control circuit 77 has an output 78 connected to the motor 34 for driving thereof.

The wake up sensor 79 has an output coupled to the switching control circuit 75. The output of the banknote clear sensor 84 is coupled to the processor 18. The switching control circuit 75 receives signals from the processor 18 in addition to those from the wake up sensor 79 and control the first and second solid state switches 74, 76 and a third solid state switch 80 which selectively couples the batteries 46 to a processor 18. Optical sensing means 82, including the tri-colour LEDs 63, the IR LEDs 64 and the optical receiver 65, operates under the control of the processor 18 and returns a signal to the processor 18 dependent upon the characteristics of a banknote passing through the validator 1. Lines 83 carry banknote and other data from the processor 18 to external circuitry. The processor 18 is also coupled to the motor control circuit 77 and a memory 85.

The operation of the validator 1, shown in the Figures will now be described. In the absence of a banknote 16, the validator 1 operates in an idle mode, in which state the second solid state switch 76 is open so that the motor 34 is de-energised, the third solid state switch 80 is open disconnecting the processor 18 from the batteries 46 and the first solid state switch 74 is closed allowing the battery pack 46 to be charged by the primary power supply circuit 70. The wake up sensor 79, the banknote clear sensor 84 and the switching control circuit 75 remain powered up during the idle mode.

A banknote 16 to be validated is inserted into the slot 8 in the facia 2 of the validator 1 either by the user deforming the note so that it conforms to the curve of the slot 8 and then inserting it locating a corner of the banknote 16 in the slot 8 and then sliding the corner along the slot 8 thus drawing the remainder of the leading edge of the banknote 16 into the slot 8. Once this has been completed, the banknote 16 can be pushed easily into the validator 1 due to the increased rigidity of the banknote 16 caused by its being bowed. After travelling a small distance into the validator 1, the banknote 16 reflects the beam of light from the optical transmitter 41 to the optical receiver of the wake up sensor 79, the light otherwise passes through the hole 43 and is not detected by said optical receiver. The wake up sensor 79 then outputs a signal to the switching control circuit 75 which in turn outputs switching signals to the solid state switches 74, 76 and 80. As a result, second solid state switch 76 is closed, creating a path between the primary power supply circuit 70 and the motor control circuit 77, and the first 74 and third 80 solid state switches change state so that the battery pack 43 becomes disconnected from the primary power supply 70 and the processor 18 is supplied with power from the batteries 46. In this way the processor 18 is re-booted for each banknote validation thereby ensuring that a processor error condition does not persist for more than one validation. Once the processor 18 is active it outputs a signal to the motor control circuit 77 which then energises the motor 34 to draw the banknote 16 into the validator 1. If this signal is not received by the motor control circuit 77, it causes the motor 34 to run in reverse for a predetermined time thereby opposing the insertion of the banknote 16.

The spindle of the energised motor 34 directly drives to the large diameter wheel 90, causing the axle 28 to turn. This in turn causes the front drive wheel 29 rotate. The banknote 16, being urged into the validator 1, is then gripped between the drive wheel 29 and the idler wheel 31 and is thereafter automatically drawn into the validator 1.

The processor 18 cyclically energises the tri-colour LEDs 63 and the infra-red LEDs 64 so that the banknote 16 is repeatedly scanned with green, red and infra-red light which is selectively reflected by the banknote pattern. Also, where a blank area on the upper surface of the banknote 16 coincides with a blank area on its lower surface, some light passes completely through the banknote 16 and is returned back through the banknote 16 to the fan-shaped light guide 17 from the aforementioned retroreflective material. Thus a characteristic pattern of light is returned from the banknote 16 through the light guide to the optical receiver 65. The signals output by the optical receiver 65 are processed by the processor 18 to check that the banknote 16 is authentic and to determine its value.

Since a single signal representing the characteristics of a transverse strip of the banknote 16 is produced by the optical sensing means 83 and the banknote path is illuminated evenly across its width, the position of the banknote 16 across the width of the banknote path does not affect validation.

As the banknote 16 progresses through the validator 1, it encounters the L-shaped member 50 of the banknote clear sensor 84. The banknote 16 acts on the lower arm **50*b* of the L-shaped member 50, forcing it to pivot causing the output of the banknote clear sensor 84 to change. Immediately thereafter, the banknote 16 is gripped between the rear drive wheels 47,48 respective idler wheels 49, 54. The toothed belt 40 couples the main axle 28 to the rear axle 91 such that the rear drive wheels 47, 48 drive the banknote 16 at the same speed, or slightly faster in order to keep the banknote 16 taught during validation, than the front drive wheel 29**.

While the note 16 is still gripped by the rear drive mechanism, the processor 18 makes the decision as to the validity of the banknote 16. If it determines the bank note to be invalid, it outputs a signal to the motor control circuit 77 which cases the motor 34 to go into reverse thus driving the banknote 16 back out through the front of the validator 1. If the processor determines that the banknote is valid the motor 34 continues to run forwards until the L-shaped member 50 of the banknote clear sensor 84 is able to pivot back to its original position (see dotted outline in FIG. **3*b*) thereby causing the output of the banknote clear sensor 84 to change back to its original state. This change of state of the banknote clear sensor 84 is detected by the processor 18 which outputs signals along lines 83 representative of the value of the banknote, e.g. £5, £10, £20 and then outputs a signal causing the switching control circuit 75 to switch the first 74, second 76, and third 80 solid states switches back to their original conditions. The output from the optical sensing means 82 is monitored until the banknote clear sensor 84 changes back to its original state. Thus cords etc., attached to banknotes as part of an attempted fraud, may be detected and the motor 34 reversed. The processor 18 may also be programmed to put the motor 34 into reverse if the banknote clear sensor 84** does not revert to its original state within a predetermined period.

The optical rotation sensor 36, 37, 38 provides a reference signal, related to the travel of the banknote 16 through the validator 1, for the processor 18. This enables a simple dc motor 34 to be employed rather than the conventional and more expensive stepper motor.

The single front drive wheel 29 results in a tendency of banknotes passing through the validator 1 to align their longitudinal sides with their direction of travel through the validator 1. While the twin rear drive wheels 47, 48 inhibit twisting of banknotes as they clear the rear of the validator 1.

In addition to the aforementioned active and inactive modes, the validator 1 has a learn mode. The validator 1 is put in this mode by operation of the switch **10*b*. During the learn mode, the processor 18 stores signals representative of a banknote passing through the validator 1 in the memory 85 for future comparison with signals representative of banknotes to be validated. The channel select switch 10*a*** enables the apparatus to be programmed with the characteritics of a plurality of banknote types and conditions.

The processor 18 may be programmed to carry out a self-calibration of the validator 1 during the period between sensing of a banknote by the wake up sensor 79 and the leading edge of the banknote reaching the fan-shaped light guide 17.

The physical arrangement of the wake up sensor, the optical receiver 65, the batteries 46 and the PCB 20 ensure that leads coupled to the processor 18 are kept short to, thereby, avoid processor errors induced by pick-up of stray electromagnetic fields.

Figure 6:
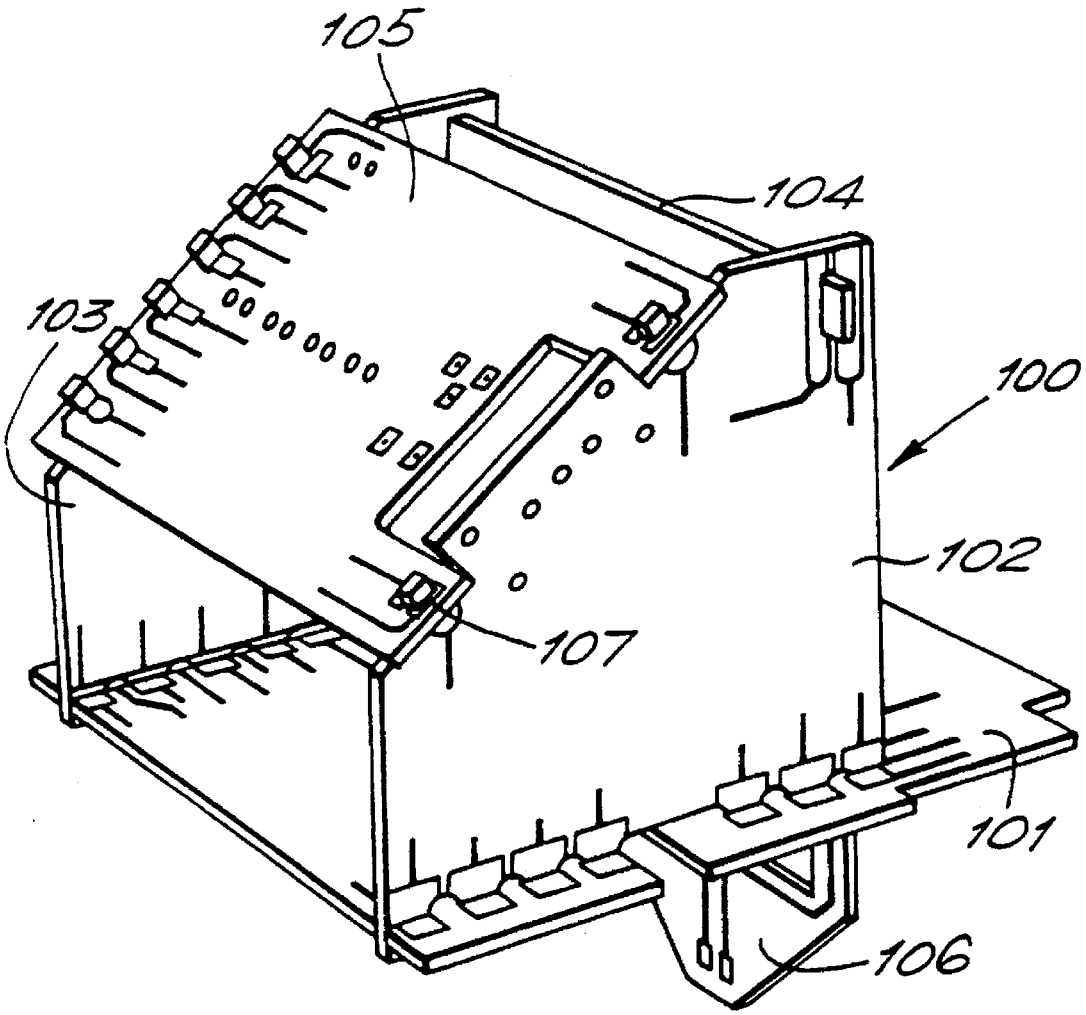
FIG. 6 is a three-dimensional printed circuit board for an electronics module.

Referring to FIG. 6, in an alternative embodiment, the majority of the electronics is incorporated into a module comprising a self-supporting three-dimensional printed circuit board 100. The printed circuit board 100 comprises a base sub-PCB 101, first and second side sub-PCBs 102, 103 extending upwardly from the base sub-PCB 101, a front sub-PCB 104 also extending upwardly from the base sub-PCB and an upper sub-PCB 105 extending between the first and second side sub-PCBs 102, 103. The sub-PCBs 101, 102, 103, 104, 105 are all substantially rectangular. However, the first and second side sub-PCBs 102, 103 have a corner diagonally cut away and it is between these cutaway portions that the upper sub-PCB 105 extends.

A substantially U-shaped sub-PCB 106 is suspended by its arms downwardly from the base sub-PCB 101, parallel to and immediately in front of the front sub-PCB 104.

The sub-PCBs are coupled together by soldered mortise and tenon joints such at that shown at 107. The mortise and tenon joints not only serve to couple the sub-PCBs together but also to transfer electrical signals therebetween. Thus, a rigid three-dimensional self-supporting printed circuit board may be constructed whilst avoiding the need for edge connectors.

Referring to FIG. 7, the printed circuit board 100 is installed within the upper portion of a validator. In this embodiment, the upper unit **4*a*, see FIG. 1, has been replaced by an intermediate interlocking unit 4*d* and a cover interlocking unit 4*e*. The intermediate interlocking unit 4*d* defines the upper surface of the note path and is coupled to the middle interlocking unit 4*b* in the same manner as used for the upper interlocking unit 4*a*. The intermediate interlocking unit 4*d* is relatively shallow and is provided at its upper margin with coupling means 108 adapted to co-operate with complementary structures 109 at the lower margin of the cover interlocking unit 4*e* so as to retain the cover unit 4*e* in position. The base sub-PCB 101 is clamped between the intermediate unit 4*d* and the cover unit 4*e* with the U-shaped sub-PCB 106 extending towards the note path. The fan-shaped light guide 17 is coupled to the base sub-PCB 101 by the leads to the LEDs and optical sensor mounted thereon. The batteries 46 are mounted within the printed circuit board 100 on the front sub-PCB 104. The U-shaped sub-PCB 106 supports the optical transmitter 41 at its lower extremity. The radiating portion of the optical transmitter 41 is located in a hole in front and in line with the idler wheel 31**.

A flying lead 110 is used to supply power to the printed circuit board 100 and also for the transfer of data to and from the printed circuit board 100. A further flying lead 111 supplies motor drive signals to the motor located in the bottom interlocking unit 4*b*. The cover interlocking unit 4*e* is provided with apertures allowing the flying leads 110 and 111 to pass therethrough.

Thus, it can be seen that when the cover unit 4*e* is removed, the module may be withdrawn together with the fan-shaped light guide 17 and the optical transmitter 41. The sub-PCBs 101, 102, 103, 104, 105, 106 may be formed from a single sheet of PCB material, the sub-PCBs 101, 102, 103, 104, 105, 106 being retained in the sheet of PCB material during mounting of at least some of the electronic devices forming the electronics of the validator.

In the embodiment shown in FIG. 8, a banknote guiding surface 9*a* of the lip 9 slopes away from the slot 8. The degree of slope varies along the length of the slot 8, the guide surface 9*a* being substantially parallel to the direction of travel of a banknote through the validator at the ends of the slot 8 and sloping at the greatest angle, to the direction of travel of a banknote through the validator, midway along the slot 8.

A validator constructed according to the present invention exhibits many advantages, including reduced size, low maintenance, low cost and ease of use.

It will be appreciated from the foregoing that the invention is not restricted solely to the validation of banknotes and is generally applicable to apparatus for discriminating between distinctive flexible sheets. Accordingly, the term banknote, as used herein simply for convenience, is to be construed to include such distinctive flexible sheets. Other examples include tickets and paper tokens.

We claim:

1. A validator suitable for validating a banknote, comprising:

an entry slot for manual insertion of the note to be validated;

an optical sensing means for sensing characteristics of a note and outputting a signal representative thereof;

processing circuitry for determining the validity of an inserted note on the basis of the signal output by the sensing means; and guide means extending inwards from said entry slot for guiding the note from the entry slot past the optical sensing means, wherein said entry slot and said guide means are so arranged that a note to be validated is caused to bow transversely of its direction of travel during insertion and movement past the optical sensing means.

2. A validator according to claim 1, wherein the guide means includes a note path along which a note to be sensed passes, and the optical sensing means comprises an elongate optical sensing area, transversely substantially coextensive with the note path, light source means for substantially evenly illuminating said sensing area over at least a major part thereof, an optical receiver station, and light guide means for causing light from the entire sensing area to converge upon the receiver station, whereby the output from the receiver station is substantially independent of the position of a note, being sensed, transversely of the note path.

3. A validator according to claim 2, wherein said light source means includes a light source at an emitter station, and said light guide is arranged to cause light to diverge from said emitter station to the sensing area.

4. A validator according to claim 3, wherein the emitter station and the receiver station are arranged at the same location.

5. A validator according to claims 2, 3 or 4, wherein the light guide includes a fan-shaped portion having an arcuate peripheral portion which at least in part defines said sensing area.

6. A validator according to claim 5, wherein the light guide includes an arm portion, extending axially from the fan-shaped portion, at the free end of which are located the emitter station and the receiver station.

7. A validator according to claim 6, wherein the light guide includes a light distributing means including an at least part conical light reflecting surface extending from the fan-shaped portion towards the free end of the arm portion for distributing light from the emitter station substantially evenly about the arcuate peripheral portion of the fan-shaped portion.

8. A validator according to claim 7, wherein the generally straight peripheral portion of the fan-shaped portion is provided with light scattering means.

9. A validator according to claim 7, wherein the light scattering means comprises a plurality of peaks and troughs.

10. A validator according to claim 5, wherein the light guiding means is moulded in one piece.

11. A validator according to any one of claims 2 to 4, wherein the light source means comprises a plurality of LEDs.

12. A validator according to any one of claims 2 to 4, wherein the optical receiver station includes a plurality of photosensitive transducers.

13. A validator according to any one of claims 2 to 4, including an electronics module comprising a self-supporting three-dimensional printed circuit board.

14. A validator according to claim 13, wherein the printed circuit board comprises a plurality of sub-boards, each sub-board including a coupling means engage an adjacent sub-board to provide both a structural and an electrical connection.

15. A validator according to claim 14, wherein the connection comprises a soldered joint.

16. A validator according to claim 15, wherein the soldered joint is a mortise and tenon joint.

17. A validator suitable for validating a banknote having a transverse dimension comprising a note input slot for manual insertion of the note to be validated, wherein said note input slot is arranged such that the note to be validated is deformed in a predetermined rigidity increasing manner during insertion through the input slot, said slot bowing the note transversely to increase the rigidity of the note in its direction of travel.

18. A validator according to claim 17, including a sheet guiding surface following the shape of the slot and extending outwardly from the validator.

19. A validator according to claim 18, wherein the slot is U-shaped and the sheet guiding surface slopes downwardly in the region of the base of the U of the slot.

20. A validator suitable for validating a banknote, comprising:

a mains power supply;

a rechargeable battery;

note detecting means for detecting the presence of a note in the validator to produce a sheet detected signal and powered by the mains power supply;

sheet scanning means for producing a signal representative of a characteristic of a note;

processing means for processing said note characteristic representing signal; and first switching means for selectively connecting the battery means to the mains power supply for charging;

second switching means for selectively connecting the battery for the processing means for powering the processing means;

wherein the validator has a standby state in which the first switching means is configured to connect the mains power supply to the battery and the second switching is configured to isolate the processing means from the battery, and the first and second switching means are responsive to the note detected signal to place the validator in an active state in which the battery is isolated from the mains power supply and the battery is connected to the processing means to supply operating power thereto.

21. A validator according to claim 20, wherein the battery is charged from the primary power supply when the processing means is in its inactive state.

22. A validator according to claim 20, wherein the battery means comprises a nickel-cadmium cell.

23. A validator, suitable for validating a banknote, comprising a sheet input means having a slot characterized in that the sheet input means, is arranged such that a sheet to be validated is deformed in a predetermined rigidity increasing manner during insertion into the input means, including a sheet guiding surface following the shape of the slot and extending outwardly from the validator, and wherein the slot is U-shaped and the sheet guiding surface slopes downwardly in the region of the base of the U of the slot.

24. A validator suitable for validating a banknote, comprising an optical sensing means for sensing characteristics of a sheet, and guide means for guiding the sheet past the optical sensing means, characterized in that said guide means is so arranged that a sheet to be validated is caused to bow transversely of its direction of travel past the optical sensing means, wherein the guide means includes a sheet path along which a sheet to be sensed passes, and the optical sensing means having an elongate optical sensing area, transversely substantially coextensive with the sheet path, light source means for substantially evenly illuminating said sensing area over at least a major part thereof, an optical receiver station, and light guide means for causing light from the entire sensing area to converge upon the receiver station, whereby the output from the receiver station is substantially independent of the position of a sheet, being sensed, transversely of the sheet path, and wherein said light source means includes a light source at an emitter stations, and said light guide is arranged to cause light to diverge from said emitter station to the sensing area.

25. A validator according to claim 24, wherein the emitter station and the receiver station are arranged at the same location.

26. A validator suitable for validating a banknote, comprising an optical sensing means for sensing characteristics of a sheet, and guide means for guiding the sheet past the optical sensing means, characterized in that said guide means is so arranged that a sheet to be validated is caused to bow transversely of its direction of travel past the optical sensing means, wherein the guide means includes a sheet path along which a sheet to be sensed passes, and the optical sensing means having an elongate optical sensing area, transversely substantially co-extensive with the sheet path, light source means for substantially evenly illuminating said sensing area over at least a major part thereof, an optical receiver station, and light guide means for causing light from the entire sensing area to converge upon the receiver stations, whereby the output from the receiver station is substantially independent of the position of a sheet, being sensed, transversely of the sheet path, and wherein the light guide includes a fan-shaped portion, having an arcuate peripheral portion which at least in part defines said sensing area.

27. A validator according to claim 26, wherein the light guide includes an arm portion, extending axially from the fan-shaped portion, at the free end of which are located the emitter station and the receiver station.

28. A validator according to claim 27, wherein the light guide includes a light distributing mean including an at least part conical light reflecting surface extending from the fan-shaped portion towards the free end of the arm portion for distributing light from the emitter station substantially evenly about the arcuate peripheral portion of the fan-shaped portion.

29. A validator according to claim 28, wherein the generally straight peripheral portion of the fan-shaped portion is provided with light scattering means.

30. A validator according to claim 28, wherein the light scattering means comprises a plurality of peak and troughs.

31. A validator according to any one of claims 26 to 30 wherein the light guiding means is molded in one piece.

* * * * *